US009081338B2

(12) United States Patent
Takeuchi et al.

(10) Patent No.: US 9,081,338 B2
(45) Date of Patent: Jul. 14, 2015

(54) IMAGE FORMING APPARATUS

(71) Applicants: Kenji Takeuchi, Nagoya (JP); Kei Ishida, Nagoya (JP); Kaoru Suzuki, Ichinomiya (JP); Yuki Fukusada, Kasugai (JP)

(72) Inventors: Kenji Takeuchi, Nagoya (JP); Kei Ishida, Nagoya (JP); Kaoru Suzuki, Ichinomiya (JP); Yuki Fukusada, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 85 days.

(21) Appl. No.: 13/760,401

(22) Filed: Feb. 6, 2013

(65) Prior Publication Data

US 2013/0202323 A1 Aug. 8, 2013

(30) Foreign Application Priority Data

Feb. 6, 2012 (JP) ..... 2012-022711

(51) Int. Cl.
*G03G 15/20* (2006.01)

(52) U.S. Cl.
CPC ..... *G03G 15/2039* (2013.01); *G03G 15/205* (2013.01); *G03G 2215/2035* (2013.01)

(58) Field of Classification Search
CPC ..... G03G 15/205; G03G 15/2039; G03G 12/2078
USPC ..... 399/69, 70
See application file for complete search history.

(56) References Cited

U.S. PATENT DOCUMENTS

| | | | | |
|---|---|---|---|---|
| 2002/0118977 | A1 | 8/2002 | Hasegawa et al. | |
| 2006/0039713 | A1 * | 2/2006 | Kishi et al. | 399/69 |
| 2008/0199198 | A1 * | 8/2008 | Nishi | 399/69 |
| 2009/0245846 | A1 * | 10/2009 | Nakashima | 399/70 |
| 2009/0311016 | A1 * | 12/2009 | Shinshi | 399/329 |

FOREIGN PATENT DOCUMENTS

JP 2002-169411 A 6/2002

* cited by examiner

*Primary Examiner* — Gregory H Curran
(74) *Attorney, Agent, or Firm* — Banner & Witcoff, Ltd.

(57) ABSTRACT

An image forming apparatus includes: a fixing device having a heating member, a heat source, a rotating member, and a temperature sensor; and a control device configured to control the heat source, wherein, in a case of a low temperature state where the temperature of the heating member is lower than a predetermined temperature, the control device to control the heat source such that the temperature of the heating member rises with a gradient equal to or greater than a predetermined value, and wherein, in a case of a high temperature state where the temperature of the heating member at the print-instruction receiving time is equal to or higher than the predetermined temperature, the control device to control the heat source such that the temperature of the heating member rises with a gradient smaller than that in the normal mode.

20 Claims, 7 Drawing Sheets

IMAGE FORMING APPARATUS

CROSS-REFERENCE TO RELATED APPLICATION

This application claims priority from Japanese Patent Application No. 2012-022711 filed on Feb. 6, 2012, the entire subject matter of which is incorporated herein by reference.

TECHNICAL FIELD

This disclosure relates to an image forming apparatus including a fixing device for thermally fixing developer images onto recording sheets, and a control device for controlling the fixing device.

BACKGROUND

It is known that an image forming apparatus has a heating member that is heated by a powered heat source, a temperature sensor for detecting the temperature of the heating member, and a control device for controlling the heat source based on the temperature detected by the temperature sensor.

This control device is configured to control a timing to supply electric power to the heat source (to turn on the heat source), according to the heated state of the vicinity of the heating member.

In other words, the control device is configured such that when the control device receives a print instruction, if the temperature detected by the temperature sensor is low, the control device supplies electric power to the heat source at an early timing; whereas if the temperature detected by the temperature sensor is high, the control device delays the timing to supply electric power to the heat source.

SUMMARY

However, even when the temperature detected by the temperature sensor is high, if the timing to supply electric power to the heat source is delayed, a large amount of electric power should be supplied to the heat source. Therefore, so-called overshoot in which the temperature of the heating member exceeds a fixing temperature too much may occur.

Therefore, this disclosure provides at least an image forming apparatus capable of suppressing overshoot of the temperature of a heating member.

In view of the above, an image forming apparatus of this disclosure includes: a fixing device having a heating member, a heat source configured to heat the heating member, a rotating member configured to rotate and to be in contact with the heating member, and a temperature sensor configured to detect the temperature of the heating member; and a control device configured to control the heat source. In the image forming apparatus, in a case of a low temperature state where the temperature of the heating member at a print-instruction receiving time is lower than a predetermined temperature, the control device performs a normal mode to control the heat source such that the temperature of the heating member rises with a gradient equal to or greater than a predetermined value. On the other hand, in a case of a high temperature state where the temperature of the heating member at the print-instruction receiving time is equal to or higher than the predetermined temperature, the control device performs a preheating mode to control the heat source such that the temperature of the heating member rises with a gradient smaller than that in the normal mode, and then transitions to the normal mode.

Here, the print-instruction receiving time indicates a print-instruction receiving moment or a time period around the print-instruction receiving moment.

Meanwhile, an image forming apparatus of another aspect of this disclosure, comprise: a fixing device including, a heating member, a heat source configured to heat the heating member, a rotating member configured to rotate and to be in contact with the heating member, and a temperature sensor configured to detect the temperature of the heating member; and a control device configured to control the heat source. In a case of a low temperature state where the temperature detected by the temperature sensor at a print-instruction receiving time is lower than a predetermined temperature, the control device performs a normal mode to control the heat source with a first output power. In a case of a high temperature state where the temperature detected by the temperature sensor at the print-instruction receiving time is equal to or higher than the predetermined temperature, the control device performs a preheating mode to control the heat source such that the temperature of the heating member rises with a second output power smaller than maximum value of the first output power, and then transitions to the normal mode.

According to this disclosure, it is possible to suppress overshoot of the temperature of the heating member.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Now, an illustrative embodiment of this disclosure will be described in detail with reference to appropriate drawings. In the following description, the general configuration of a laser printer 1 will be first described in brief as an example of an image forming apparatus according to the illustrative embodiment of this disclosure, and then a fixing device and a control device will be described in detail.

Figure 1:
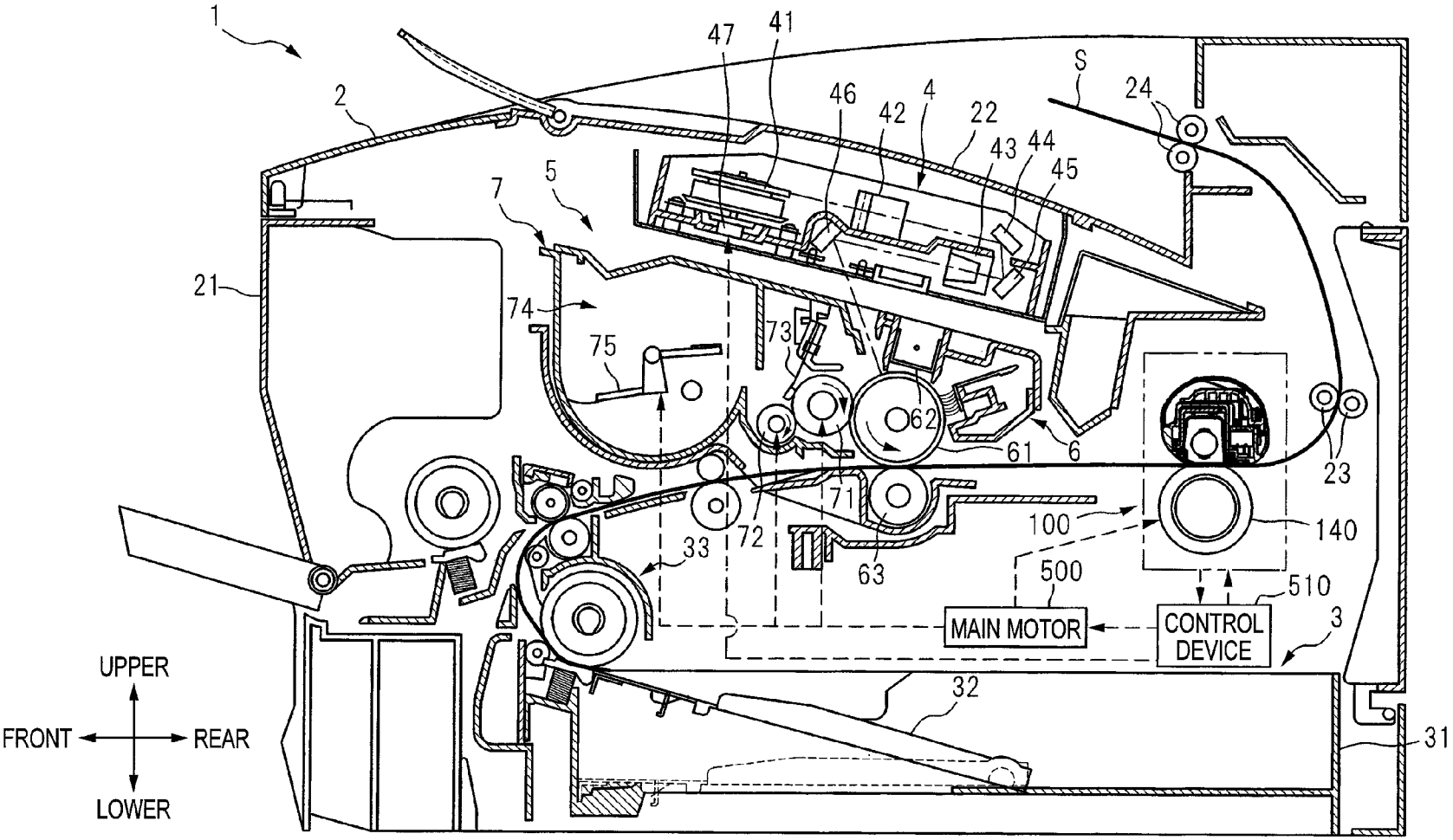
FIG. 1 is a cross-sectional view illustrating a laser printer according to an illustrative embodiment of this disclosure.

Also, in the following description, directions of the laser printer 1 refer to the directions as seen from a user facing to the laser printer during its use. To be more specific, referring to FIG. 1, a left-side direction and a right-side direction of the drawing sheet are referred to as a "front side" and a "rear side" of the laser printer, respectively. Also, a direction away from a viewer of FIG. 1 is referred to as a "left side", and a direction toward the viewer of FIG. 1 as a "right side". An upper and lower direction in FIG. 1 is referred to as an "upper-lower direction".

<General Configuration of Laser Printer>

As shown in FIG. 1, the laser printer 1 mainly includes a sheet feeding unit 3, an exposing device 4, a processing cartridge 5, and a fixing device 100 inside a main body casing 2. The sheet feeding unit 3 feeds a sheet S as an example of a recording sheet, the processing cartridge 5 transfers a toner image (developer image) onto the sheet S, and the fixing device 100 thermally fixes the toner image onto the sheet S.

The sheet feeding unit 3 is provided at the lower portion of the inside of the main body casing 2, and mainly includes a sheet feed tray 31, a sheet pressing plate 32, and a sheet feeding mechanism 33. Sheets S stored in the sheet feed tray 31 are pulled upward by the sheet pressing plate 32, and are fed toward the processing cartridge 5 (between a photosensitive drum 61 and a transfer roller 63) by the sheet feeding mechanism 33.

The exposing device 4 is disposed at the upper portion of the inside of the main body casing 2, and includes a laser-beam emitting unit (not shown), a polygon mirror 41, lenses 42 and 43, reflective mirrors 44, 45, and 46, and a polygon mirror motor 47 which is for rotating the polygon mirror 41. In the exposing unit 4, a laser beam (see a chain line) based on image data is emitted from the laser emission unit, is reflected by or passes through the polygon mirror 41, the lens 42, the reflecting mirrors 44 and 45, the lens 43, and the reflecting mirror 46, in their order. Thus, the laser beam is irradiated onto a surface of the photosensitive drum 61 to scan the surface of the photosensitive drum 61 at high speed, so that the surface of the photosensitive drum 61 is exposed.

The process cartridge 5 is disposed below the exposing unit 4, and it is configured to be attachable and detachable with respect to the main body casing 2 from an opening shown when a front cover 21 provided to the main body casing 2 is open. The process cartridge 5 is configured by a drum unit 6 and a developing unit 7.

The drum unit 6 mainly includes the photosensitive drum 61, a charger 62, and a transfer roller 63. Also, the developing unit 7 is configured to be attachable and detachable with respect to the drum unit 6, and mainly includes a developing roller 71, a feeding roller 72, a layer-thickness regulating blade 73, a toner container 74 for containing toner (developer), and an agitator 75 for agitating the toner in the toner container 74.

In the process cartridge 5, the surface of the photosensitive drum 61 is uniformly charged by the charger 62, and then is exposed by high-speed scanning with the laser beam from the exposing unit 4, so that an electrostatic latent image based on the image data is formed on the photosensitive drum 61. Further, the toner in the toner container 74 is supplied to the developing roller 71 through the feeding roller 72, and enters into a gap between the developing roller 71 and the layer-thickness regulating blade 73, so as to be held as a thin layer having a constant thickness on the developing roller 71.

The toner held on the developing roller 71 is supplied from the developing roller 71 to the electrostatic latent image formed on the photosensitive drum 61. Therefore, the electrostatic latent image is visualized, that is, a toner image is formed on the photosensitive drum 61. Then, a sheet S is conveyed between the photosensitive drum 61 and the transfer roller 63, so that the toner image on the photosensitive drum 61 is transferred onto the sheet S.

The fixing device 100 is provided on the rear side relative to the process cartridge 5. The transferred toner image (toner) transferred on the sheet S passes through the fixing device 100, so that the toner image is fixed on the sheet S by heat. Then, the sheet S is discharged onto a sheet discharge tray 22 by conveyance rollers 23 and 24.

<Detailed Configuration of Fixing Device>

Figure 2:
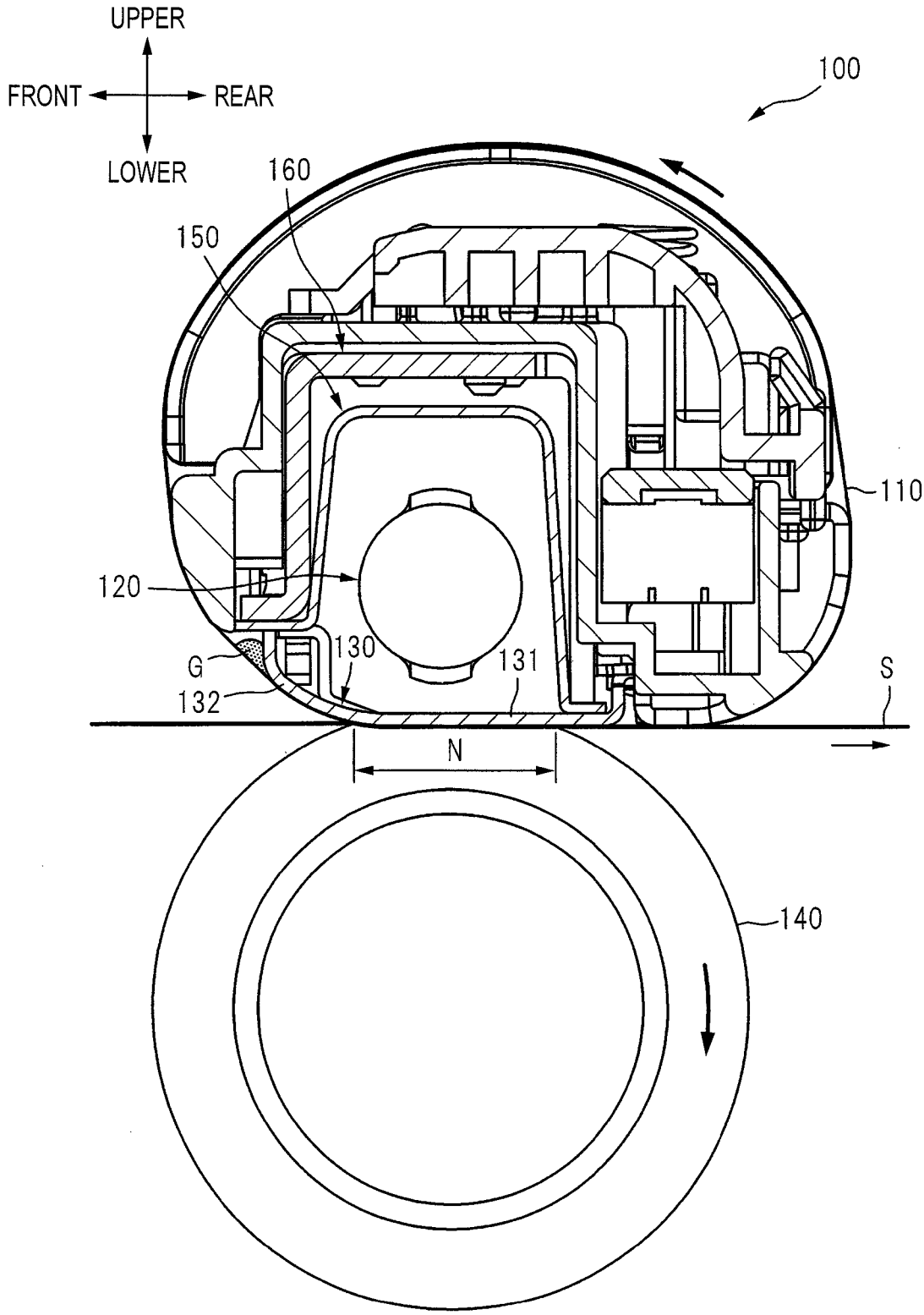
FIG. 2 is a cross-sectional view illustrating a fixing device.

As shown in FIG. 2, the fixing device 100 includes a nip plate 130 and a fixing belt 110 as an example of a heating member, a halogen lamp 120 as an example of a heat source, a pressing roller 140 as an example of a rotating member, a reflective plate 150, and a stay 160.

The fixing belt 110 is an endless (cylindrical) belt made of stainless steel and having heat resistance and flexibility. Inside the fixing belt 110, the halogen lamp 120, the nip plate 130, the reflective plate 150, and the stay 160 are provided.

The halogen lamp 120 is a member which emits radiant heat to heat the nip plate 130 and the fixing belt 110 (a nip portion N), thereby heating the toner on the sheet S. The halogen lamp 120 is disposed with a predetermined gap from the inner surface of the nip plate 130.

The nip plate 130 is a plate-shaped member which receives the radiant heat from the halogen lamp 120, and it is disposed such that the lower surface of the nip plate 130 is in sliding contact with the inner circumferential surface of the fixing belt 110. In the present illustrative embodiment, the nip plate 130 is made of a metal. For example, the nip plate 130 is formed by bending an aluminum plate having heat conductivity higher than that of the stay 160 made of steel (to be described below). In the case of making the nip plate 130 of aluminum, it is possible to improve the heat conductivity of the nip plate 130.

Figure 3:
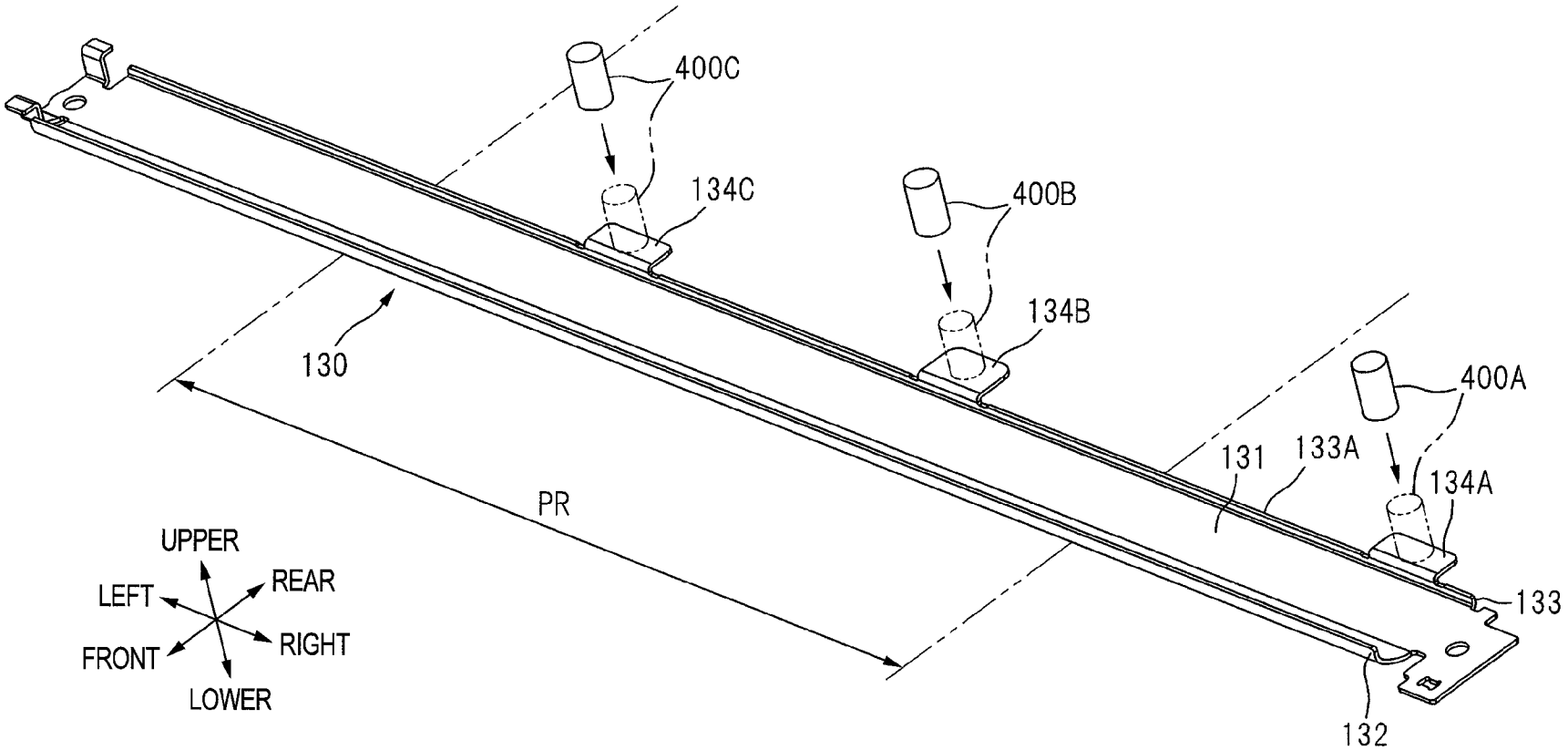
FIG. 3 is a perspective view illustrating a nip plate and a temperature sensor.

As shown in FIGS. 2 and 3, the nip plate 130 includes a plate-like portion 131, a front bent portion 132, a rear bent portion 133, and three detection target portions 134.

The plate-like portion 131 is an elongated plate-like member which is perpendicular to a upper-lower direction and is long in a left-right direction, and the fixing belt 110 is sandwiched between the plate-like portion 131 and the pressing roller 140 in the upper-lower direction, so that the nip portion N is formed between the plate-like portion 131 and the fixing belt 110. Further, the plate-like portion 131 is disposed below the halogen lamp 120, and it is configured to transfer heat from the halogen lamp 120 to the toner on the sheet S through the fixing belt 110.

Also, on the inner surface (upper surface) of the plate-like portion 131, painting may be performed in black, or a heat absorbing member may be provided. In this case, it is possible to efficiently absorb the radiant heat from the halogen lamp 120.

The front bent portion 132 is formed to be bent in an almost arc shape upward from the front end side (upstream side in a predetermined direction) of the plate-like portion 131 to be disposed to face the halogen lamp 120. Therefore, the front bent portion 132 is directly heated by the halogen lamp 120. As a result, it is possible to heat (preheat) the sheet S having not entered the nip portion N, in advance, by the front bent portion 132, so that it is possible to improve a thermally fixing characteristic.

The rear bent portion 133 is formed to extend from the rear end edge of the plate-like portion 131 toward the upper side (the radially inner side of the fixing belt 110). Specifically, the rear bent portion 133 is formed to extend from one end side of the rear end edge of the plate-like portion 131 to the other end side in the left-right direction. Therefore, it is possible to use the rear bent portion 133 to effectively suppress lubricant G attached to the inner circumferential surface of the fixing belt 110 from flowing onto the upper surface of the plate-like portion 131 (for example, a surface painted in black). As a result, it is possible to suppress a reduction in the heating efficiency of the nip plate 130.

The three detection target portions 134A, 134B, and 134C are portions whose temperatures are detected by a side thermistor 400A, a thermostat 400B, and a center thermistor 400C, respectively. The three detection target portions 134A, 134B, and 134C are formed to extend from portions of the upper end edge 133A of the rear bent portion 133 toward the rear side. Specifically, two detection target portions 134B and 134C are disposed almost at the center portion of the rear bent portion 133 extending in the left-right direction, and one detection target portion 134A is disposed at one end portion on the outer side of the rear bent portion 133 in the left-right direction.

Also, as shown in FIG. 3, the detection target portions 134B and 134C are disposed inside a minimum sheet passage range PR in the left-right direction, and the detection target portion 134A is disposed outside the minimum sheet passage range PR in the left-right direction. Here, the minimum sheet passage range PR indicates a passage range of sheet having the minimum width in the left-right direction, within sheet which can be used in the laser printer 1.

Here, the side thermistor 400A and the center thermistor 400C are temperature sensors for transmitting detected temperatures to a control device 510, and the thermostat 400B is a thermal switch for mechanically cutting electricity to the halogen lamp 120 if a detected temperature exceeds a predetermined temperature.

Additionally, the side thermistor 400A may be a contact type thermistor for coming into contact with the detection target portion 134A so as to detect the temperature of the detection target portion 134A, or may be a non-contact type thermistor for detecting the temperature of the detection target portion 134A without coming into contact with the detection target portion 134A.

Similarly, the center thermistor 400C may be a contact type thermistor for coming into contact with the detection target portion 134C so as to detect the temperature of the detection target portion 134C, or may be a non-contact type thermistor for detecting the temperature of the detection target portion 134C without coming into contact with the detection target portion 134C.

The pressing roller 140 is a member to sandwich the fixing belt 110 between the pressing roller 140 and the nip plate 130, thereby forming the nip portion N between the pressing roller 140 and the fixing belt 110, and it is disposed below the nip plate 130. Further, in order to form the nip portion N, one of the nip plate 130 and the pressing roller 140 is biased toward the other. Furthermore, the pressing roller 140 is configured to rotate by a driving force transmitted from a main motor 500 (see FIG. 1) provided inside the main body casing 2, and it is configured to rotate together with the fixing belt 110 in a state where the fixing belt 110 and the sheet S are sandwiched between the pressing roller 140 and the nip plate 130, thereby conveying the sheet S toward the rear side.

The reflective plate 150 is a member which reflects the radiant heat from the halogen lamp 120 toward the nip plate 130, and it is disposed inside the fixing belt 110 so as to surround the halogen lamp 120 with predetermined gaps from the halogen lamp 120. The reflective plate 140 is formed by bending, for example, an aluminum plate having high reflectivity for infrared rays and far infrared rays, almost in a U shape in a cross-sectional view.

The stay 160 is a member which supports the nip plate 130 through the reflective plate 150 and receives a load from the pressing roller 140 to surround the halogen lamp 120 and the reflective plate 150 inside the fixing belt 110. Here, it is assumed that the load is corresponding to a reaction force to the force of the nip plate 130 biasing the pressing roller 140 in the configuration where the nip plate 130 biases the pressing roller 140. This stay 160 is formed by bending a material having relatively high rigidity, for example, a steel plate.

The halogen lamp 120, the main motor 500 for driving the pressing roller 140, and the like of the fixing device 100 configured as described above, and the above-mentioned polygon mirror motor 47 are configured to be controlled by the control device 510 shown in FIG. 1. Also, the main motor 500 is configured not only to supply a driving force to the pressing roller 140 through a gear mechanism (not shown) but also to supply driving forces to the developing roller 71, the feeding roller 72, and the agitator 75 through another gear mechanism (not shown). In other words, if the main motor 500 is driven, the pressing roller 140, the developing roller 71, the feeding roller 72, and the agitator 75 rotate at the same time.

<Control Device>

Now, the control device 510 will be described in detail.

As shown in FIG. 1, the control device 510 includes, for example, a CPU, a RAM, a ROM, and an input/output circuit and performs arithmetic processing based on inputs from the above-mentioned center thermistor 400C and side thermistor 400A, the contents of a print instruction, programs and data stored in the ROM, and the like, thereby controlling the halogen lamp 120, the main motor 500, and the polygon mirror motor 47. Also, a temperature sensor to be used for the following control may be any one of the side thermistor 400A and the center thermistor 400C. However, in the present illustrative embodiment, it is assumed that the temperature sensor to be used for the following control is the center thermistor 400C.

The control device 510 is configured to turn on the halogen lamp 120 if receiving a print instruction, and the control device 510 changes control on the halogen lamp 120, the main motor 500, and the polygon mirror motor 47 according to the temperature of the nip plate 130 at the print-instruction receiving time.

In a case where the laser printer 1 is powered on (the power source is on), in a standby period, the control device 510 basically keeps the halogen lamp off 120 until a print instruction is received. Here, the standby period is corresponding to a period when the power source is on and it is possible to receive a print instruction, except for an initial error check period.

Figure 4:
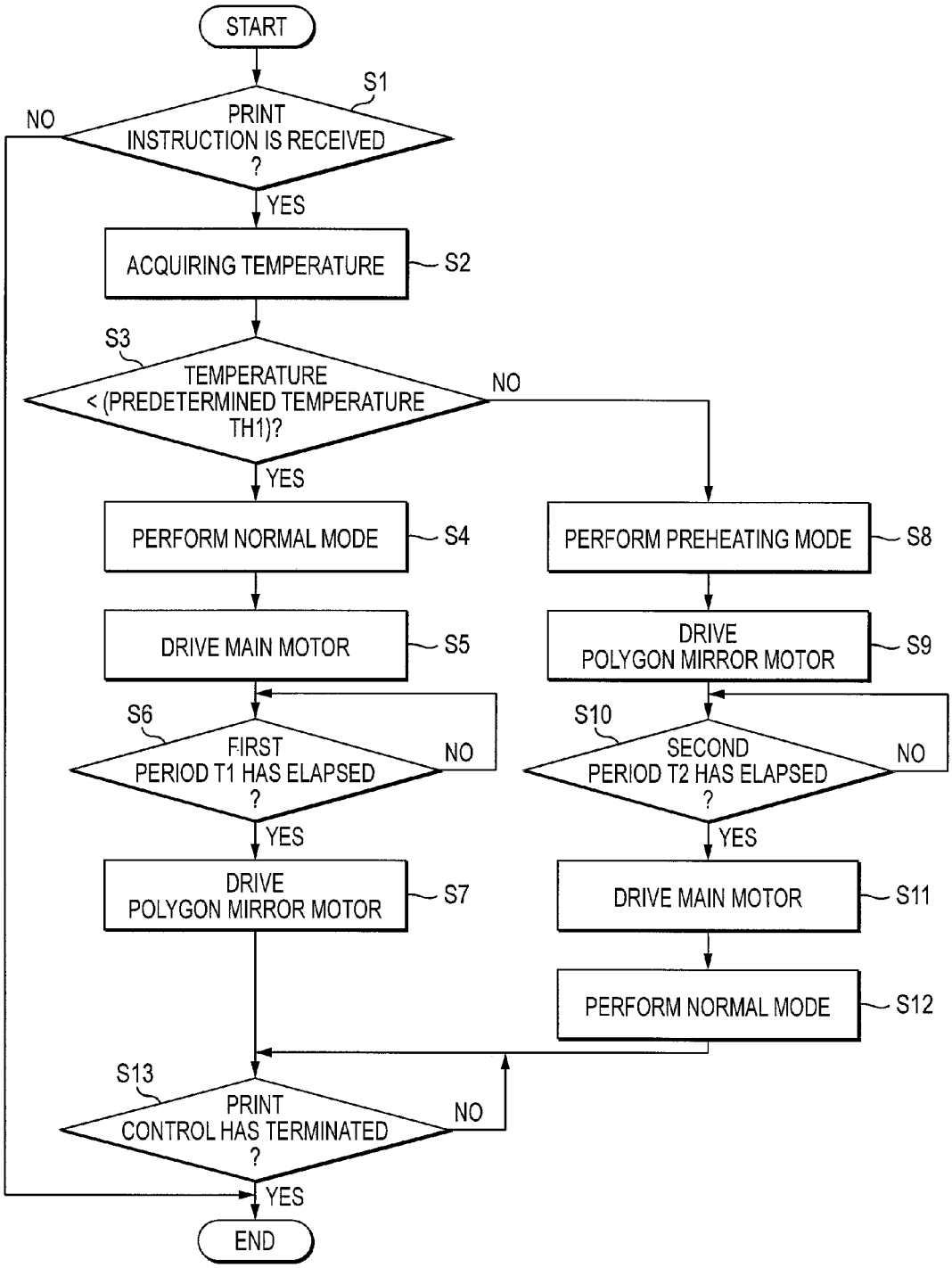
FIG. 4 is a flow chart illustrating the operation of a control device.

Specifically, the control device 510 performs control according to a flow chart shown in FIG. 4 when the laser printer 1 is powered on. In this control, first the control device 510 determines whether any print instruction has been received (step S1).

In a case where any print instruction has not been received in step S1 (No), the control device 510 just terminates the present control such that the halogen lamp 120 is maintained in the OFF state. In a case where a print instruction has been received in step S1 (Yes), the control device 510 acquires the temperature of the nip plate 130 from the center thermistor 400C (step S2). After step S2, the control device 510 determines whether the temperature of the nip plate 130 at the print-instruction receiving time is lower than a predetermined temperature TH1 (step S3).

Here, the predetermined temperature TH1 is a threshold value for distinguishing a low temperature state, where the internal temperature of the laser printer 1 is low to some extent, and a high temperature state, where the internal temperature of the laser printer 1 is higher than the low temperature state, and it is can be appropriately set by experiments or the like. In the present illustrative embodiment, the predetermined temperature TH1 is set to 152° C.

In a case where the temperature of the nip plate 130 is lower than the predetermined temperature TH1 in step S3, that is, in a case of the low temperature state (Yes), the control device 510 performs a normal mode to control the halogen lamp 120 such that the temperature of the nip plate 130 rises with a gradient equal to or greater than a predetermined value G1 (see FIG. 5) (step S4), and then drives the main motor 500 (step S5). The predetermined value G1 can be appropriately set by experiments or the like. In the present illustrative embodiment, the predetermined value G1 is 20° C./sec.

Here, the normal mode is corresponding to a mode in which the temperature of the halogen lamp 120 is raised to a fixing temperature TH2 (see FIG. 5) based on the temperature detected by the center thermistor 400C and is maintained at the fixing temperature TH2. Additionally, in FIGS. 5 and 6, for the sake of convenience, the output of the halogen lamp 120 during the normal mode is shown as a constant value. However, actually, the output appropriately changes based on the temperature of the center thermistor 400C.

After step S5, the control device 510 determines whether a first period T1 has elapsed from the print-instruction receiving time (step S6). Here, the first period T1 can be appropriately set based on a time period from when the driving of the main motor 500 starts to when the driving of the main motor 500 is stabilized, that is, to when a large amount of electric power required during the start of the driving becomes unnecessary.

In a case where the first period T1 has elapsed in step S6 (Yes), the control device 510 drives the polygon mirror motor 47 (step S7).

In a case where the temperature of the nip plate 130 is equal to or higher than the predetermined temperature TH1 in step S3, that is, in a case of the high temperature state (No), the control device 510 performs a preheating mode (see FIG. 6) to control the halogen lamp 120 such that the temperature of the nip plate 130 (the detected temperature of the center thermistor 400C rises with a gradient smaller than the gradient during the normal mode (the gradient of the predetermined value G1) (step S8), and then drives the polygon mirror motor 47 (step S9).

In the present illustrative embodiment, the preheating mode is corresponding to a mode in which the halogen lamp 120 is turned on for a predetermined period TA from the print-instruction receiving time, and then is turned off. Also, in the present illustrative embodiment, the output of the halogen lamp 120 in the preheating mode is made smaller than the maximum value in the normal mode. Specifically, in the preheating mode, the control device 510 controls the halogen lamp 120 to be turned on for 0.6 sec with a duty ratio of 33%.

Referring to FIG. 4 again, the rest of the control will be described. After step S9, the control device 100 determines whether a second period T2 has elapsed from the print-instruction receiving time (step S10). Here, the second period T2 is a value appropriately set based on a time period from when the driving of the polygon mirror motor 47 starts to when the driving of the polygon mirror motor 47 is stabilized, that is, to when a large amount of electric power required during the start of the driving becomes unnecessary, and it is set to a time period longer than the first period T1.

In a case where the second period T2 has elapsed in step S10 (Yes), the control device 510 drives the main motor 500 (step S11) and then transitions from the preheating mode to the normal mode (step S12). After step S12 or after step S7, the control device 510 determines whether the print control has terminated (step S13). In a case where the print control has not terminated (No), the control device 510 returns to the process of step S13. In a case where the print control has terminated (Yes), the control device 510 terminates the present control.

Sequentially, specific examples of control of the control device 510 during a low temperature and during a high temperature will be described with reference to FIGS. 5 and 6.

Figure 5:
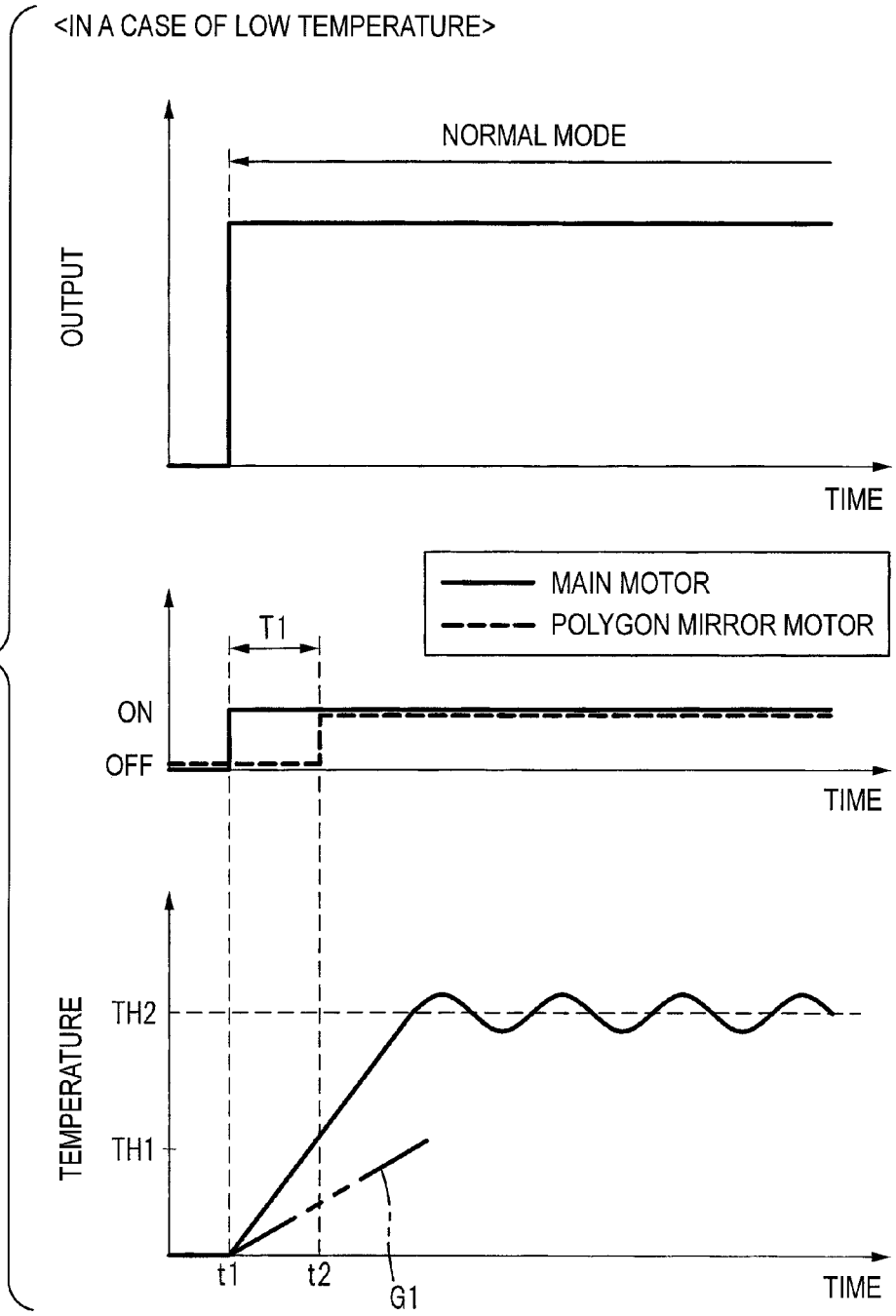
FIG. 5 is a time chart illustrating the relation between the operations of a halogen lamp and individual motors and the temperature of the nip plate during a low temperature.

As shown in FIG. 5, if receiving a print instruction (time t1) and determining that it is in the low temperature state (lower than the predetermined temperature TH1), the control device 510 turns on the halogen lamp 120, starts control in the normal mode, and drives the main motor 500. Therefore, in the case of the low temperature state, the temperature of the nip plate 130 rises with a gradient equal to or greater than the predetermined value G1 by the normal mode. As a result, it is possible to quickly raise the temperature of the nip plate 130 to the fixing temperature TH2.

Also, in the case of the low temperature state, the main motor 500 is driven earlier than the polygon mirror motor 47, so that it is possible to rotate the pressing roller 140 at the same time as the halogen lamp 120 is turned on. Therefore, it is possible to suppress the temperature of the nip portion N between the fixing belt 110 and the pressing roller 140, which are not rotating, from excessively rising to damage the fixing belt 110 and the like.

Further, when the first period T1 elapses from the print-instruction receiving time (the time t1), the control device 510 drives the polygon mirror motor 47 (a time t2). In other words, after a large amount of electric power required during the start of the driving of the main motor 500 becomes unnecessary, the polygon mirror motor 47 is driven. Therefore, as compared to a form in which the main motor 500 and the polygon mirror motor 47 are driven at the same time, it is possible to prevent a large amount of power from being consumed in a short time.

Figure 6:
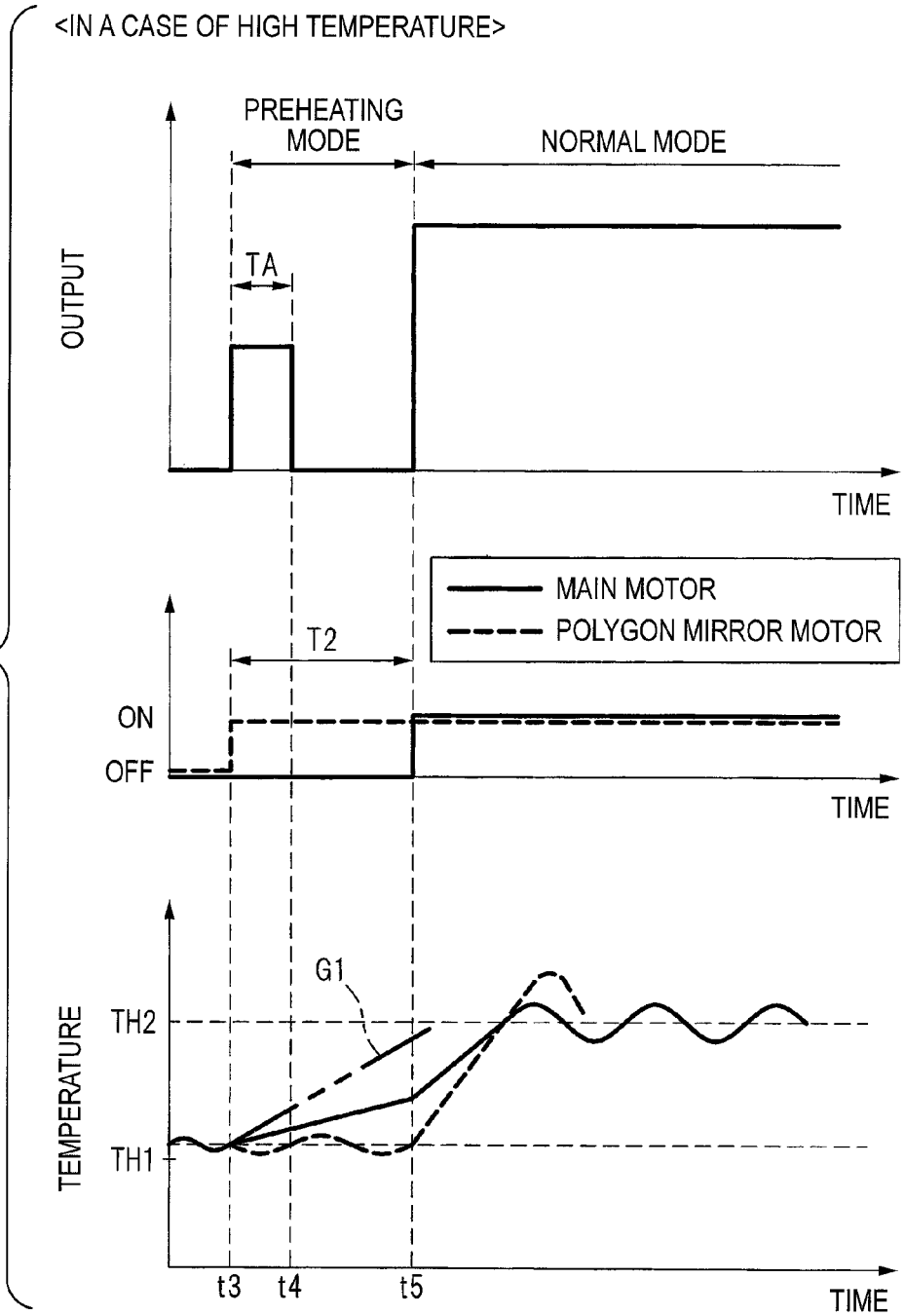
FIG. 6 is a time chart illustrating the relation between the operations of the halogen lamp and the individual motors and the temperature of the nip plate during a high temperature.

As shown in FIG. 6, if receiving a print instruction (a time t3) and determining that it is in the high temperature state (equal to or higher than the predetermined temperature TH1), the control device 510 turns on the halogen lamp 120, starts control in the preheating mode, and drives the polygon mirror motor 47. Further, in the preheating mode, when the predetermined period TA elapses from the print-instruction receiving time (the time t3), the control device 510 turns off the halogen lamp 120 (a time t4).

Therefore, in the case of the high temperature state, the temperature of the nip plate 130 rises with a gradient smaller than the gradient of the predetermined value G1 by the preheating mode. As a result, it is possible to approximate the temperature of the nip plate 130 to the fixing temperature TH2, so that it is possible to suppress overheating of the nip portion N due to stop of the main motor 500.

Further, if the second period T2 elapses from the print-instruction receiving time (the time t3), the control device 510 drives the main motor 500 and turn on the halogen lamp 120 again to perform control in the normal mode (a time t5). Since the timing when the halogen lamp 120 is turned on again and the timing when the driving of the main motor 500 starts are synchronized, for example, as compared to a form in which the main motor is driven later than the timing when the halogen lamp is turned on again, it is possible to further suppress overheating of the nip portion N due to stop of the main motor 500.

According to the above-mentioned configuration, it is possible to obtain the following effects in the present illustrative embodiment.

In a case where the temperature at the print-instruction receiving time (the time t3) is in the high temperature state, before transition to the normal mode, it is possible to approximate the temperature of the nip plate 130 to the fixing temperature TH2 by the preheating mode. Therefore, for example, as compared to control as shown by a broken line in the drawing, the slope of the temperature gradient when the temperature of the heating member reaches the fixing temperature TH2 is reduced, and thus it is possible to suppress overshoot. Here, control shown by a broken line represents control in which the halogen lamp 120 is turned off for a predetermined standby period (T2) from the print-instruction receiving time (the time t3) and is turned on after the predetermined standby period.

Also, this disclosure is not limited to the above-mentioned illustrative embodiment, but can be used in various forms as exemplified below.

Figure 7:
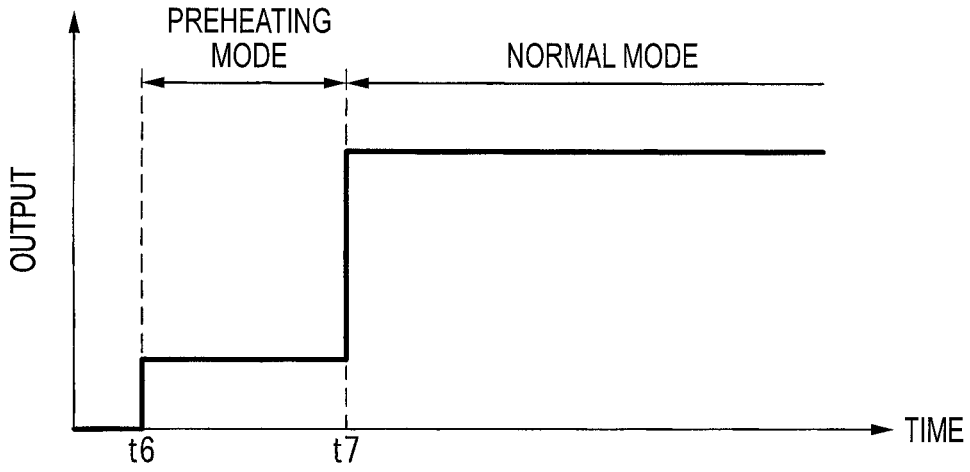
FIG. 7 is a time chart illustrating a modification of a preheating mode.

In the above-mentioned illustrative embodiment, in the preheating mode, the halogen lamp 120 is turned on only for the predetermined period TA, and then is turned off until transition to the normal mode. However, this disclosure is not limited thereto. For example, as shown in FIG. 7, if the output of the halogen lamp in the preheating mode is made smaller than the maximum value in the normal mode, in the preheating mode (from a time t6 to a time t7), the halogen lamp may be maintained in the ON state.

In the above-mentioned illustrative embodiment, the control device 510 is configured to control the halogen lamp 120 to be tuned off in the standby period. However, the control device 510 may be configured to control the halogen lamp 120 such that the detected temperature of the center thermistor 400C becomes lower than the fixing temperature TH2 in the standby period.

In the above-mentioned illustrative embodiment, this disclosure has been applied to the laser printer 1. However, this disclosure is not limited thereto. This disclosure may be applied to other image forming apparatuses, for example, copy machines, multi-function apparatuses, and so on.

In the above-mentioned illustrative embodiment, as an example of the heat source, the halogen lamp 120 has been exemplified. However, this disclosure is not limited thereto. For example, the heat source may be a heat element, an IH heat source, or the like. Here, the IH heat source is corresponding to a heat source which does not produce heat by itself but makes a roller or a metal belt produce heat according to an electromagnetic-induction heating scheme.

In the above-mentioned illustrative embodiment, as an example of the heating member, the fixing belt 110 and the nip plate 130 have been exemplified. However, this disclosure is not limited thereto. For example, the heating member may be a heating roller which is a metal tube thicker than the fixing belt 110.

In the above-mentioned illustrative embodiment, the pressing roller 140 (the rotating member) is rotated by the main motor 500. However, this disclosure is not limited thereto. The motor needs only to rotate at least one of the rotating member and the heating member. For example, in a case where the heating member is the heating roller, the heating roller may be driven by the motor.

In the above-mentioned illustrative embodiment, as an example of the recording sheet, the sheets S such as thick sheet, card, and thin sheet have been used. However, this disclosure is not limited thereto. For example, the recording sheet may be an OHP sheet.

In the above-mentioned illustrative embodiment, as an example of the rotating member, the pressing roller 140 has been exemplified. However, this disclosure is not limited thereto. For example, the rotating member may be a belt-like pressing member or the like.

Also, a control device for controlling the heat source and a control device for controlling each motor may be separate, and may be configured as one control device.

In the above-mentioned illustrative embodiment, as an example of a photoreceptor, the photosensitive drum 61 has been exemplified. However, this disclosure is not limited thereto. For example, the photoreceptor may be a belt-like photoreceptor.

Additionally, the heating member may includes, an endless belt having an inner surface defining an inner space; and a nip member disposed at the inner space of the endless belt and configured to pinch the endless belt between the nip member and the rotating member.

Additionally, the control device may be configured to perform a sleep mode and a standby mode, and, in the standby mode, the control device basically keeps the heat source off. In the standby mode, the control device may keep the heat source in an OFF state. The heat source may be separate from the nip member. The heat source may be a halogen lamp.

What is claimed is:

1. An image forming apparatus comprising:

a fixing device including:

a heating member;

a heat source configured to heat the heating member;

a rotating member configured to rotate and to be in contact with the heating member; and a temperature sensor configured to detect a temperature of the heating member;

a control device configured to control the heat source;

an exposing device including a polygon mirror and configured to expose a photoreceptor;

a polygon mirror motor configured to drive the polygon mirror; and a main motor configured to drive at least one of the rotating member and the heating member, wherein, in a case of a low temperature state where the temperature of the heating member at a print-instruction receiving time is lower than a predetermined temperature, the control device first drives the main motor and then drives the polygon mirror motor, and the control device performs an operation of a normal mode to control the heat source such that the temperature of the heating member rises to a fixing temperature with a gradient equal to or greater than a predetermined value and then is maintained at the fixing temperature, and wherein, in a case of a high temperature state where the temperature of the heating member at the print-instruction receiving time is equal to or higher than the predetermined temperature, the control device first drives the polygon mirror motor and then drives the main motor, and the control device performs an operation of a preheating mode comprising turning on the heat source for a first predetermined period of time and turning off the heat source for a second predetermined period of time such that the temperature of the heating member rises with a gradient less than the predetermined value.

2. The image forming apparatus according to claim 1, wherein the first predetermined period of time begins at the print-instruction receiving time.

3. The image forming apparatus according to claim 1, wherein, in the preheating mode, the control device controls the heat source to output a maximum output power less than a maximum output power of the heat source in the normal mode.

4. The image forming apparatus according to claim 1, wherein the heating member includes:

an endless belt having an inner surface defining an inner space; and a nip member disposed at the inner space of the endless belt and configured to pinch the endless belt between the nip member and the rotating member.

5. The image forming apparatus according to claim 4, wherein the rotating member is a roller.

6. The image forming apparatus according to claim 1, wherein the control device includes a central processing unit (CPU).

7. The image forming apparatus according to claim 1, wherein the control device is configured to perform an operation of a standby mode, and wherein, in the standby mode, the control device determines whether a print instruction is received.

8. The image forming apparatus according to claim 7, wherein, in the standby mode, the control device keeps the heat source off.

9. The image forming apparatus according to claim 4, wherein the heat source is separate from the nip member.

10. The image forming apparatus according to claim 9, wherein the heat source is a halogen lamp.

11. An image forming apparatus comprising:

a fixing device including:

a heating member;

a heat source configured to heat the heating member;

a rotating member configured to rotate and to be in contact with the heating member; and a temperature sensor configured to detect a temperature of the heating member;

a control device configured to control the heat source;

an exposing device including a polygon mirror and configured to expose a photoreceptor;

a polygon mirror motor configured to drive the polygon mirror; and a main motor configured to drive at least one of the rotating member and the heating member, wherein, in a case of a low temperature state where the temperature detected by the temperature sensor at a print-instruction receiving time is lower than a predetermined temperature, the control device first drives the main motor and then drives the polygon mirror motor, and the control device performs an operation of a normal mode to control the heat source such that the heat source outputs a first output power, and wherein, in a case of a high temperature state where the temperature detected by the temperature sensor at the print-instruction receiving time is equal to or higher than the predetermined temperature, the control device first drives the polygon mirror motor and then drives the main motor, and the control device performs an operation of a preheating mode comprising turning on the heat source for a first predetermined period of time and turning off the heat source for a second predetermined period of time such that the heat source outputs a second output power less than the first output power.

12. The image forming apparatus according to claim 11, wherein the first predetermined period of time begins at the print-instruction receiving time.

13. The image forming apparatus according to claim 11, wherein the heating member includes:

an endless belt having an inner surface defining an inner space; and a nip member disposed at the inner space of the endless belt and configured to pinch the endless belt between the nip member and the rotating member.

14. The image forming apparatus according to claim 13, wherein the rotating member is a roller.

15. The image forming apparatus according to claim 11, wherein the control device is configured to perform an operation of a standby mode, wherein, in the standby mode, the control device determines whether a print instruction is received.

16. The image forming apparatus according to claim 15, wherein, in the standby mode, the control device keeps the heat source off.

17. The image forming apparatus according to claim 13, wherein the heat source is separate from the nip member.

18. The image forming apparatus according to claim 17, wherein the heat source is a halogen lamp.

19. The image forming apparatus according to claim 11, wherein, in the preheating mode, the control device controls the heat source to output a maximum output power less than a maximum output power of the heat source in the normal mode.

20. The image forming apparatus according to claim 11, wherein the control device includes a central processing unit (CPU).

* * * * *